US012766362B2

(12) United States Patent
Kim

(10) Patent No.: US 12,766,362 B2
(45) Date of Patent: Oct. 20, 2026

(54) EXERCISE METHOD AND DEVICE

(71) Applicant: Eun Bee Kim, Chuncheonsi (KR)

(72) Inventor: Eun Bee Kim, Chuncheonsi (KR)

( * ) Notice: Subject to any disclaimer, the term of this patent is extended or adjusted under 35 U.S.C. 154(b) by 291 days.

(21) Appl. No.: 18/636,373

(22) Filed: Apr. 16, 2024

(65) Prior Publication Data

US 2024/0261630 A1 Aug. 8, 2024

Related U.S. Application Data

(63) Continuation of application No. 17/928,325, filed as application No. PCT/KR2021/006706 on May 29, 2021, now abandoned.

(30) Foreign Application Priority Data

Nov. 29, 2020 (KR) ..... 10-2020-0163490
Dec. 19, 2020 (KR) ..... 10-2020-0179121
Apr. 9, 2021 (KR) ..... 10-2021-0046813

(51) Int. Cl.
*A63B 23/04* (2006.01)
*A63B 21/00* (2006.01)
*A63B 23/035* (2006.01)

(52) U.S. Cl.
CPC ..... *A63B 23/0405* (2013.01); *A63B 21/154* (2013.01); *A63B 21/4034* (2015.10); *A63B 21/4045* (2015.10); *A63B 21/4047* (2015.10); *A63B 23/03533* (2013.01); *A63B 2208/0233* (2013.01); *A63B 2208/0242* (2013.01)

(58) Field of Classification Search
CPC ..... A63B 23/0488; A63B 23/03533; A63B 23/0405; A63B 22/06; A63B 21/4034; A63B 21/4045; A63B 21/4047; A63B 21/154; A63B 2208/0233; A63B 2208/0242
See application file for complete search history.

(56) References Cited

U.S. PATENT DOCUMENTS 5,314,392 A * 5/1994 Hawkins ..... A63B 22/0056 482/52
5,800,323 A * 9/1998 Ansel ..... A63B 21/169 482/904
7,350,796 B2 * 4/2008 Misevski ..... B62M 3/06 280/260

(Continued)

FOREIGN PATENT DOCUMENTS

JP 16237053 8/2004
KR 1020160020729 2/2016

(Continued)

*Primary Examiner* — Joshua T Kennedy

(57) ABSTRACT

The present invention relates to an exercise device comprising, a pivot axis separated into a right axis and a left axis, wherein the right axis and the left axis are connected by using bevel gears, wherein as a ratchet bearing or a free wheel is provided on the y-axis or the arm, the y-axis idles when the y-axis rotates in one direction, and the arm fixed to the y-axis rotates in the same direction as the y-axis when the y-axis rotates in the other direction, so that when the user connects the arm to the y-axis, the user puts the user's legs together to contact one end of the arm and puts the user's legs apart, and when the arm is fixed to a x-axis a user performs a movement of lowering legs.

1 Claim, 21 Drawing Sheets

(56) References Cited

U.S. PATENT DOCUMENTS

| | | | | |
|---|---|---|---|---|
| 2005/0101449 | A1* | 5/2005 | Fan | A63B 22/0605 482/57 |
| 2010/0093496 | A1* | 4/2010 | Clark | A63B 21/4049 482/51 |
| 2026/0097260 | A1* | 4/2026 | Brunella | A63B 22/0076 |

FOREIGN PATENT DOCUMENTS

| | | | | |
|---|---|---|---|---|
| KR | 10-1792430 | | 10/2017 | |
| KR | 101792430 | B1 * | 10/2017 | A63B 22/0605 |
| KR | 20180100005 | A * | 9/2018 | A63B 23/0476 |

* cited by examiner

EXERCISE METHOD AND DEVICE

TECHNICAL FIELD

The present invention relates to an exercise method and an exercise device for performing an exercise suitable for thigh and hip muscles such as fitness equipment and an exercise bicycle, and more particularly to an exercise method and an exercise device for strengthening thigh and hip muscles by performing a movement of lowering legs and then moving the legs backward or putting the legs together or apart from a position of pulling the legs toward a chest of the user with an arm disposed between the legs in a sitting or lying position of the user.

BACKGROUND ART

In general, as illustrated in FIG. 1, an exercise for strengthening thigh and hip muscles is performed by pulling legs toward a chest and compressing the legs to the outside by using a pelvis as an axis. However, since a typical exercise method and an exercise device directly transmit a load to an ankle and a knee, ankle and knee joints may be damaged, and a person having weak ankle and knee joints may not perform the exercise method.

In addition, a typical bicycle that is generally used by a knee patient has been developed to go faster more distance with a less force. Thus, as illustrated in FIG. 2, since the bicycle has a pivot axis disposed around an ankle, an exercise is concentrated on lower legs and gives a small effect on upper legs and a hip joint. Thus, a prior bicycle of this inventor expand an exercise range suitable for a motion range of knee joints and the hip joint and increase the exercise effect to be used for exercises.

Specifically, the prior invention of the inventor expands a motion range of the hip joint and the knees by arranging an arm pivot axis of the prior exercise device in parallel to the hip joint in a corresponding manner in order to use the bicycle for exercises.

Also, as a foot plate or a foot pad of the exercise device connected to a weight is positioned on a thigh of an exercising leg, and a movement of raising the exercising leg toward a chest and rotating the leg backward in a sitting or lying position of the user is performed, a force transmitted to the knee and the ankle decreases.

Technical Problem

As illustrated in FIG. 2, a typical fixed-type bicycle that is generally used by a user who has a weak knee has an insignificant effect of strengthening a hip joint because a motion range of the hip joint is restricted, and an axis of a movement is fixed (an exercise range of about 10 to 20). As illustrated in FIG. 1, a general motion range of the hip joint of a human is about 120°. Thus, the prior invention of this inventor expands the motion range such that a pivot axis of an exercise device is disposed parallel to a position of a hip joint of a body of a user, and the user performs an exercise of lowering thighs and moving the thighs backward from a start position of pulling the thighs to a chest of the user. However, the exercise device according to the above-described invention shows a few problems. Thus, technical objects will be described below.

First, the exercise device according to the invention has inconvenience in that the user is necessary to change a seat position during exercises when a single arm and a single pivot part are provided so that a seat does not disturb rotation of the arm, and a pivot axis of the arm corresponds to a hip joint (first problem).

Second, a motion range of a knee and a hip joint is necessary to be changed for each injured portion for rehabilitation treatment. For example, the cruciate ligament tear has a knee motion range that becomes opposite according to whether the portion is anterior or posterior. Also, the motion range of a hip joint exercise is changed for a patient with spinal disc herniation according to injured portions. However, the exercise device according to the prior invention is not suitable for patients with spinal disc herniation, anterior cruciate ligament rupture, and posterior cruciate ligament rupture because the motion range of the hip joint exercise is 120° or more of a normal person (second problem). Thus, an effective rehabilitation exercise device capable of selecting the exercise motion range according to a body state of a patient.

Third, the prior exercise device, in which the pivot axis and the hip joint are disposed parallel to perform a movement of lowering legs and moving the legs backward from a start position in which the user sits on the seat, places the legs on one end of the arm, and pulls the legs toward the chest of the user, causes discomfort because a length of the arm of the exercise device contacting the body is changed according to a rotation angle of the hip joint or the knee joint. For example, a distance from the pivot axis to the pedal decreases when the legs are raised, and the distance increases when the legs are lowered. However, a length of the arm is fixed to cause discomfort. Also, knees are over-bent or over-extended to generate side effects (third problem). Thus, the length of the arm is necessary to be varied according to the variation of the length of the leg to the pivot axis.

Fourth, the exercise device according to the prior invention causes discomfort because the pedal rotates by using a bar as an axis when a foot is placed on the pedal to perform a linear movement.

Fifth, in case of a typical bicycle, the arm rotates by 360° to automatically move from an exercise end section to an exercise start section. In case of the exercise device according to the prior invention, the exercise section is within 180°, the arm does not returned from the end section to the start section.

Sixth, in case of an axis conversion device of the exercise device according to the prior invention, when a roller connected to a resistance body is hinged from x-axis parallel to the ground to a y-axis perpendicular to the ground, the roller is easily worn because a wire is not fixed to the roller, and thus the wire hits the roller.

Seventh, the exercise device according to the prior invention requires expensive manufacturing costs because each of a y-axis pivot axis connected to the arm and a bevel gear set is provided in plurality and is easily broken as a volume of a gear device increases.

Eighth, the exercise device according to the prior invention may not perform a basic leg muscle resistance exercise such as squat, lunge, and deadlift. In case of the exercise device according to the prior invention, a handle hits the body of the user like an exercise device suitable for the thigh and hip muscles such as a total hip machine.

Ninth, the exercise device according to the prior invention may perform a leg exercise, but may not perform an upper body exercise.

Tenth, the exercise device according to the prior invention occupies a wide space when stored indoor.

SUMMARY

In order to solve the first problem, an exercise device according to the present invention is configured such that as an arm slides within a guiding range of a guiding rail 2, and the guiding rail 2 is disposed between both legs of a user when viewed on a plan view, a seat 4 and the arm are not overlapped with each other although the user does not change a position of the seat 4, and two arm pivot parts are not provided to both sides (KR 20-2020-0001877).

In order to solve the third problem, the exercise device according to the present invention performs a movement in which a portion of the body connected to an arm rotates and simultaneously compresses by providing a shock absorber to the arm having one end connected to a pivot axis and allows a length of the arm to be extended and then restored through the shock absorber when a length of legs are changed according to a rotation angle. The shock absorber may have a gas cylinder shape and apply a resistive force by a spring in addition to gases (KR 10-2021-0040066).

In order to solve the fourth problem, The exercise device according to the present invention is configured such that as a pipe and a bar that linearly moves in the pipe are provided to the arm instead of the shock absorber, a portion of the body connected to the arm rotates and simultaneously compresses, and the length of the arm is extended and then restored to an original state through the pipe and a bar 11 that linearly moves in the pipe. In addition, as a second pipe 22 connected parallel to the pipe is provided, a second bar 21 is provided in the second pipe, and a second bar fixing body 20 is provided on the bar, when the bar linearly moves from the inside to the outside of the pipe, the second bar also linearly moves from the inside to the outside of the pipe, so that the pedal 5 does not rotate about the bar (KR 10-2021-0046163, KR 10-2021-0046813). Through the above-described invention, an effect of simultaneously performing a rotation exercise and a compression exercise is generated.

In order to solve the fifth problem, the exercise device according to the present invention is configured such that as the axis is separated into a left side and a right side, and the left and right sides are organically connected by using a gear and a roller, the exercise device is returned from an exercise end section to an exercise start section (KR 20-2020-0152414).

In order to solve the sixth problem, the exercise device according to the present invention is configured to move on an x-axis parallel to the ground and rotate on a y-axis perpendicular to the ground by using a spiral gear or a bevel gear. In addition, as the gear device is manufactured to have a gear box shape, a user may attach the gear device to an existing exercise device in order to recycle the existing exercise device. Furthermore, as a time belt, a belt, and a sprocket are inserted into a pipe having a rectangular shape or a pipe shape provided below the seat, a belt pulley or a sprocket is connected to the gear device according to the present invention, and the belt pulley is connected to a resistive body of the existing bicycle (KR 10-2020-0152414, KR 10-2020-0153238), (KR 10-2020-0170941, 10-2020-0179121, 10-2021-0002955).

In order to solve the eighth problem, the exercise device according to the present invention includes a handle angle adjusting device for adjusting an angle of a handle of the exercise device to adjust a position of the handle, so that the handle does not contact the body of the user when performing lunge, squat, or deadlift (KR 10-2021-0058860).

In order to solve the tenth problem, the exercise device according to the present invention make the exercise device in the form of a desk or a chair to be used as furniture when the exercise device is not used for exercises. In addition, in order to solve the tenth problem, the exercise device according to the present invention includes a simple band (KR 20-2020-0001795).

Advantageous Effects

Hereinafter, advantageous effects of the present invention will be described.

First, the exercise device according to the present invention may simply strengthen the thigh and hip muscles instead of changing the position of the seat by the user or providing two arm pivot parts to both the sides (KR20-2020-0001877).

Second, The exercise device according to the present invention increases the exercise effect by applying the rotational force and the compressional force in a complex manner and performs the exercise similar to the natural movement, and when the user performs the exercise of pulling the legs toward the chest and then lowering the legs and rotating backward through the movement in which the bar linearly moves in the pipe, the length of the arm is flexibly extended and then automatically restored according to the substantial variation of the legs contacting the arm during the hip joint pivot exercise (KR 10-2021-0040066).

Third, the left and right arms of the exercise device organically rotate by using the roller and are automatically restored from the exercise end section to the exercise start section.

Fourth, the gear device moves on the x-axis parallel to the ground or rotates on the y-axis perpendicular to the ground by using the bevel gear or the spiral gear to solve the phenomenon of abrasion of the wire connected to the roller, and the resistive body of the existing bicycle may be used by attaching the gear device to the existing bicycle to solidify the technology of the exercise device according to the prior invention and recycle the existing bicycle (KR 10-2020-0152414, KR 10-2020-0153238, KR 10-2020-0163490).

Fifth, the exercise device according to the present invention includes the handle angle adjusting device for adjusting the angle of the handle, so that the handle is not brought into contact with the body of the user when performing lunge, squat, or deadlift (KR 10-2021-0058860).

Sixth, the exercise device is provided in the form of the desk or the chair to be used as furniture when the exercise device is not used (KR 10-2021-0035113). Also, the exercise device is provided in the simple band shape to be easily stored (KR 20-2020-0001795).

As a result, the user who have the weak knee and ankle joints or the user who wants to strengthen the thigh and hip muscles without strain of the joints may perform the thigh and hip muscle strengthening exercise by using the exercise method and the exercise device to strength the muscles, ultimately reduce the risk of disease such as diabetes, prevent obesity, and promote health after the middle age. Also, the present invention helps to aesthetically shape the body and athletes to improve the sports ability without strain of the knee and ankle joints.

BRIEF DESCRIPTION OF THE DRAWINGS

FIG. 27 is a front view illustrating a gear device of an embodiment of the present invention, including a single y-axis that is perpendicular to the ground;

FIG. 28 is a perspective view of an embodiment of the present invention illustrating an axis conversion gear device attached to a bicycle to a leg pad is disposed below the thigh of the user (15*a*);

FIG. 29 is a perspective view of an embodiment of the present invention illustrating an axis conversion gear device attached to a bicycle to a leg pad is disposed below the leg of the user (15*b*);

FIG. 30 is a front view of an embodiment of the present invention illustrating an axis conversion gear device attached to a bicycle wherein a leg pad has "⌊" shape;

FIG. 31 is a partial view of an embodiment of the present invention illustrating a gear device using ring gear 130 and sun gear 120;

FIG. 32 is a partial view of an embodiment of the present invention illustrating a gear device using ring gear 130 and sun gear 120;

FIG. 33 is a partial view of an embodiment of the present invention illustrating a gear device using ring gear and sun gear;

FIG. 34 is a partial view of an embodiment of the present invention illustrating a gear device using ring gear 130 and sun gear 120;

FIG. 35 is an exploded view of an embodiment of the present invention illustrating a gear device using ring gear 130 and sun gear 120;

FIG. 36 is a side view illustrating a gear device of an embodiment of the present invention attached to a bicycle;

FIG. 37 is a partial view of an embodiment of the present invention illustrating a gear device using a one-way bearing 150;

FIG. 38 is a partial view of an embodiment of the present invention illustrating a gear device using spur gear 19*a* and 19*b;*

FIG. 39 is a partial view of an embodiment of the present invention illustrating a gear device using spur gear 19*a* and 19*b;*

FIG. 40 is a partial view of an embodiment of the present invention illustrating a gear device using spur gear 19*a* and 19*b;*

FIG. 41 is a front view illustrating a gear device of an embodiment of the present invention attached to a bicycle;

FIG. 42 is a partial view of an embodiment of the present invention illustrating a gear device using spur gear 19*a* and 19*b;*

FIG. 43 is a perspective view of an embodiment of the present invention illustrating a guide rail 32, and a roller 31 and a gear device of FIGS. 17-18;

FIG. 44 is a perspective view of an embodiment of the present invention in the form of a desk or a chair to be used when the exercise device is not used for exercise;

FIG. 45 is a front view of an embodiment of the present invention in the form of a desk or a chair to be used when the exercise device is not used for exercise;

FIG. 46 is a side view of an embodiment of the present invention in the form of a desk or a chair to be used when the exercise device is not used for exercise;

FIG. 47 is a plan view of an embodiment of the present invention in the form of a desk or a chair to be used when the exercise device is not used for exercise;

FIG. 48 is a perspective view of an embodiment of the present invention in the form of a desk or a chair to be used when the exercise device is not used for exercise, illustrating an arm adjusted to enable outer thigh exercise;

FIG. 49 is a perspective view of an embodiment of the present invention in the form of a desk or a chair to be used when the exercise device is not used for exercise, illustrating an arm adjusted to enable deadlift exercise;

FIG. 50 is a perspective view of an embodiment of the present invention in the form of a desk or a chair to be used when the exercise device is not used for exercise, illustrating an arm adjusted to enable squat exercise;

FIG. 51 is a perspective view of an embodiment of the present invention in the form of a desk or a chair to be used when the exercise device is not used for exercise, illustrating an arm adjusted to enable leg extension exercise;

FIG. 52 is a partial view of an embodiment of the present invention in the form of a desk or a chair to be used when the exercise device is not used for exercise, illustrating an arm attaching and detaching device 67;

FIG. 53 is a perspective view of an embodiment of the present invention in the form of a desk or a chair to be used when the exercise device is not used for exercise, illustrating an arm attaching and detaching device 67.

BEST MODE FOR CARRYING OUT THE INVENTION

Figure 1:
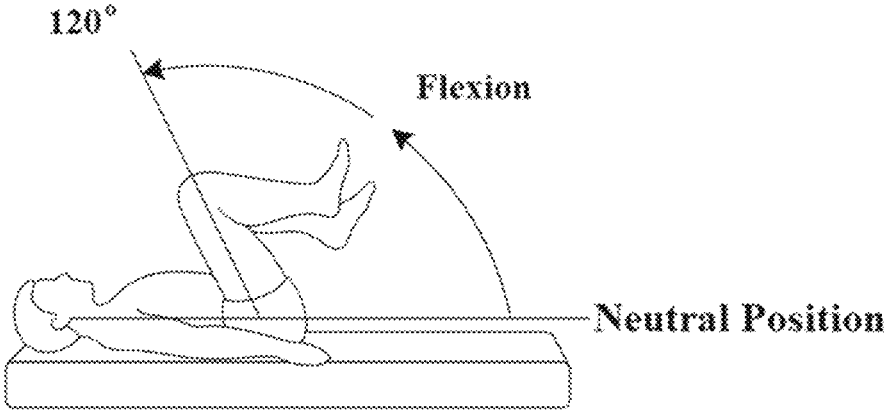
Figure 1 Prior Art
FIG. 1 illustrates general hip rotation using a pelvis as an axis.
Figure 2:
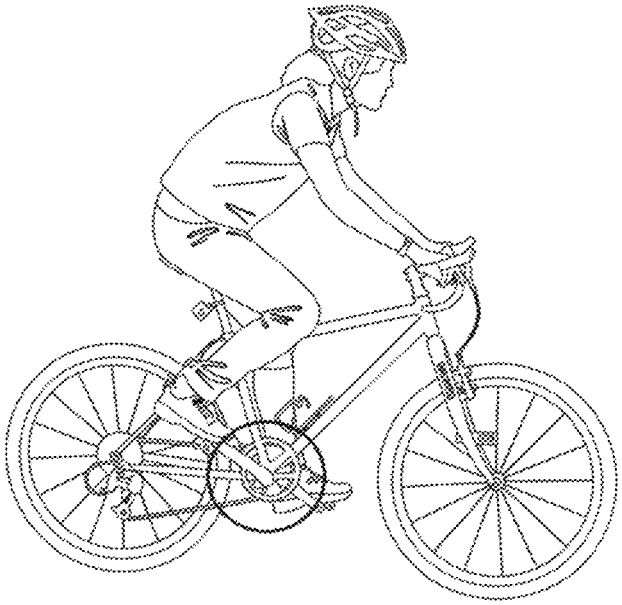
Figure 2 Prior Art
FIG. 2 illustrates the general bicycle pivot axis disposed around an ankle.

Embodiments of the present invention provide an exercise device that is a bicycle, an indoor bicycle, or fitness equipment, the exercise device including a frame 1, a handle 7 connected to the frame, a seat 4 connected to the frame, a pivot axis 11 connected to the frame 1, an arm 10 connected to the pivot axis, a pipe 12*a* connected to the arm, and a bar 12*b*, that linearly moves in the pipe, so that a user performs a movement of lowering legs and moving the legs backward by using a hip joint of the user as an axis from a start position in which the user sits or lies on the seat 4, places the legs on the leg pad, and pulls the legs toward a chest of the user.

DETAILED DESCRIPTION OF THE INVENTION

Hereinafter, detailed descriptions related to well-known functions or configurations will be ruled out in order not to unnecessarily obscure subject matters of the present invention. Since the present invention may, however, be embodied in different forms and various modifications and variations can be made in the present invention, specific embodiments will be described in detail with reference to the accompanying drawings. However, this does not limit the present invention within the specific embodiments and it should be understood that the present invention covers all the modifications, equivalents, and replacements within the idea and technical scope of the present invention. In the following description, the technical terms are used only for explaining a specific example (or embodiment) while not limiting the present disclosure. In the present invention, the meaning of 'include' or 'comprise' specifies a property, a fixed number, a step, an operation, an element, a component, or a combination thereof but does not exclude other properties, fixed numbers, steps, operations, elements, components, combinations thereof.

Hereinafter, an embodiment of a quads and gluteus exercise of the present invention to achieve the above-described objects will be described in detail with reference to the accompanying drawings.

In order to resolve a first problem of the technical object, as illustrated in FIGS. 3 to 8 (KR 20-2020-0001877), an exercise device of the present invention, which performs an exercise suitable for a quads and gluteus exercise, may include: a frame 1; a seat 4 connected to the frame 1 and allowing a user to have a sitting or lying position; a guiding rail 2 connected to the frame 1; a slide arm 3 slidingly moving with a guiding range of the guiding rail 2; and a leg pad pivotably connected to one end of the slide arm 3 and disposed below legs of the user or disposed to contact a rear surface of the legs of the user.

Figure 5:
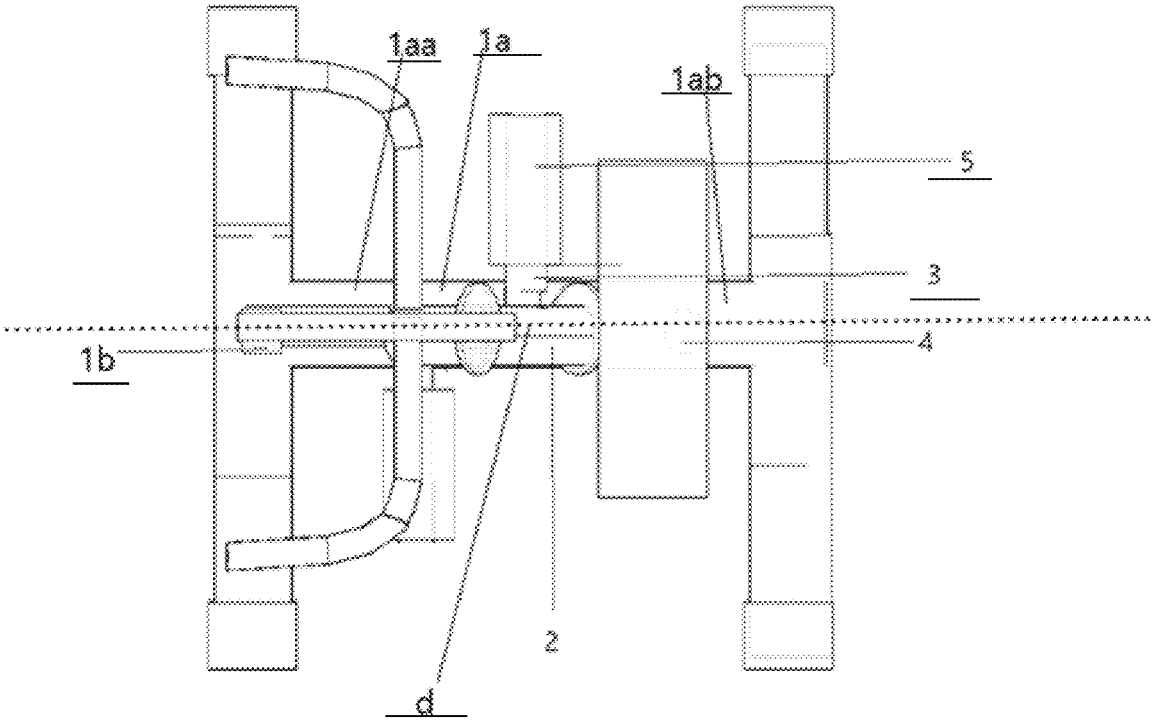
FIG. 5 is a plan view of an embodiment of the present invention illustrating a guiding rail adjusted in a direction perpendicular to the ground.

Also, as the slide arm 3 and the guiding rail 2 are provided so that the slide arm 3 moves along the guiding rail 2 to allow the slide arm 3 to rotate about a pivot axis disposed in a hip joint of the user, the pivot axis of the slide arm 3 rotating along the guiding rail 2 may be disposed corresponding to the hip joint of the user, and as the guiding rail 2 is disposed between both legs of the user when viewed on a plan view as illustrated in FIG. 5, the user may perform a movement in which the user sitting or lying on the seat 4 puts both the legs on the leg pads and alternately lowers the legs and moves the legs backward from a start position in which the legs are pulled toward the user's chest.

Preferably, the leg pad is necessary to be disposed on a rear surface of a thigh of the user to protect knees and ankle joints of the user. Also, as illustrated in FIGS. 3, 4, 6, and 7, a foot plate or a pedal 5 may be connected to one end of the leg pad.

Figure 7:
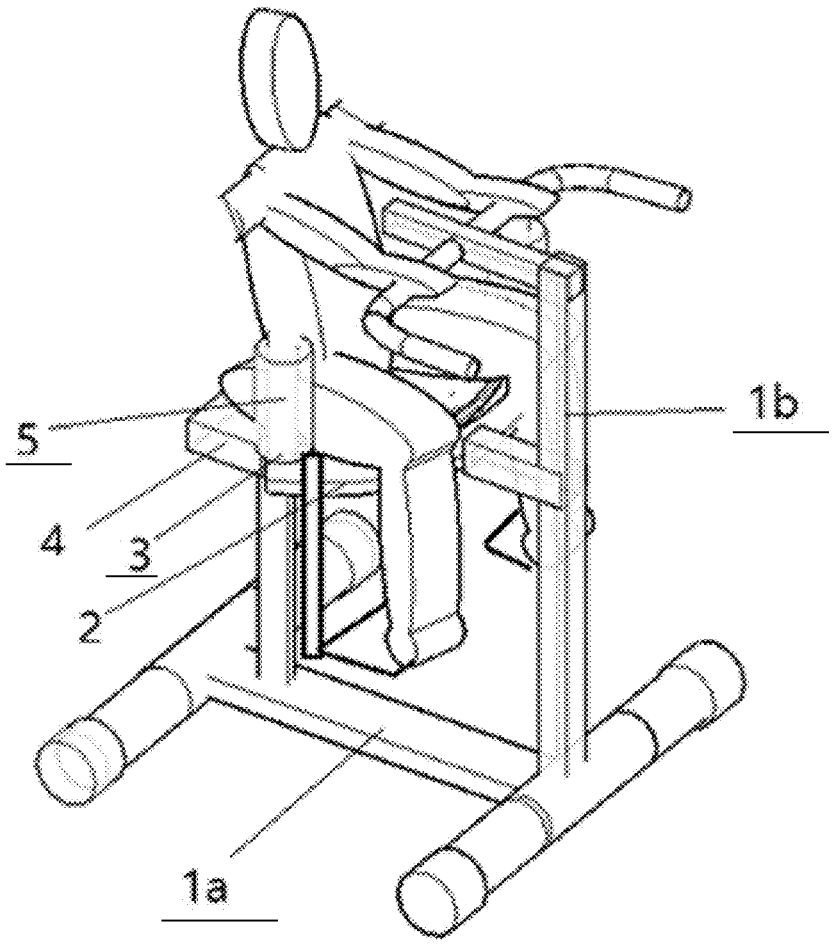
FIG. 7 is a perspective view of an embodiment of the present invention illustrating a guiding rail adjusted in a direction parallel to the ground.
Figure 8:
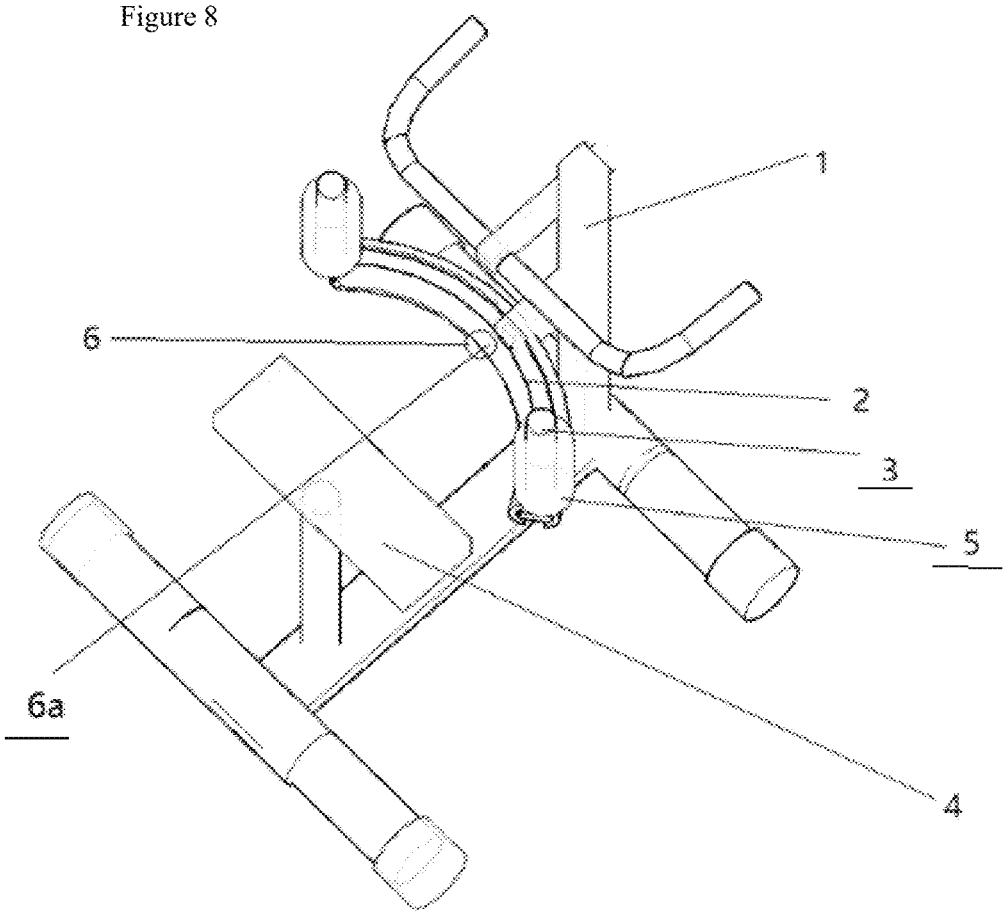
FIG. 8 is a perspective view of an embodiment of the present invention illustrating a guiding rail adjusted in a direction parallel to the ground.
Figure 9:
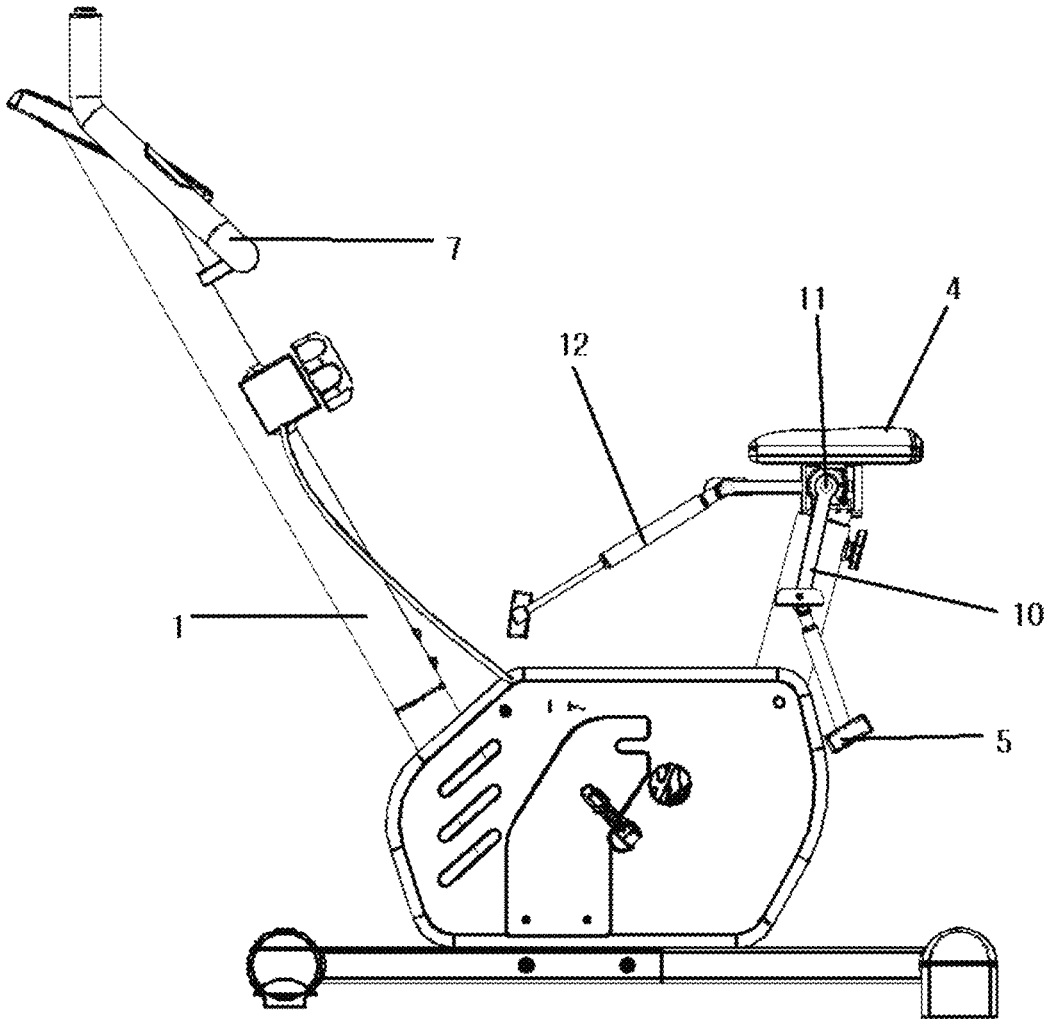
FIG. 9 is a side view of an embodiment of the present invention illustrating an arm having an end connected to a pivot axis 11 and a second end coupled to an end of an arm elongation means 12.

In addition, preferably, as illustrated in FIG. 8, the exercise device may be configured to adjust suitably for a portion of a user's body that the user wants to exercise as the guiding rail 2 connected to the frame 1 includes an axis conversion part that converts the guiding rail in a direction of a X-pivot axis parallel to the ground (FIGS. 3, 4, and 5), in a direction of a y-pivot axis perpendicular to the ground (FIGS. 6, 7, and 8), and in a diagonal direction when an angle to the ground is 45°.

Figure 3:
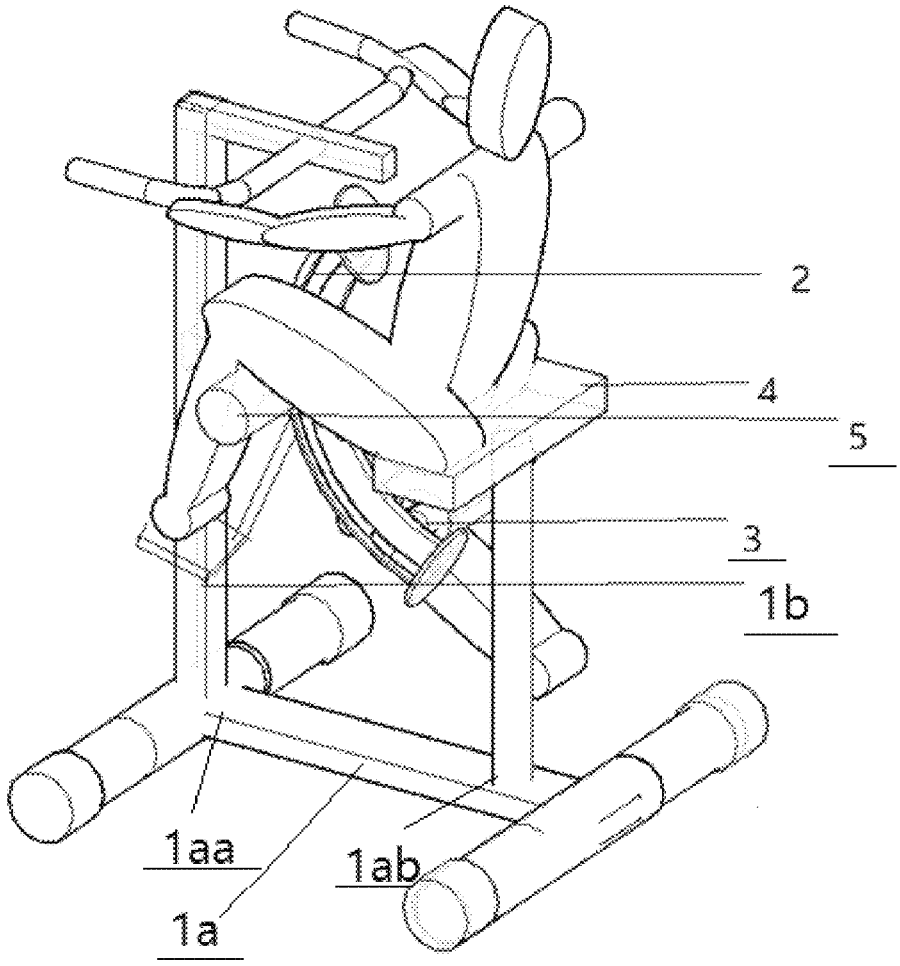
FIG. 3 is a perspective view of an embodiment of the present invention illustrating a guiding rail adjusted in a direction perpendicular to the ground.
Figure 4:
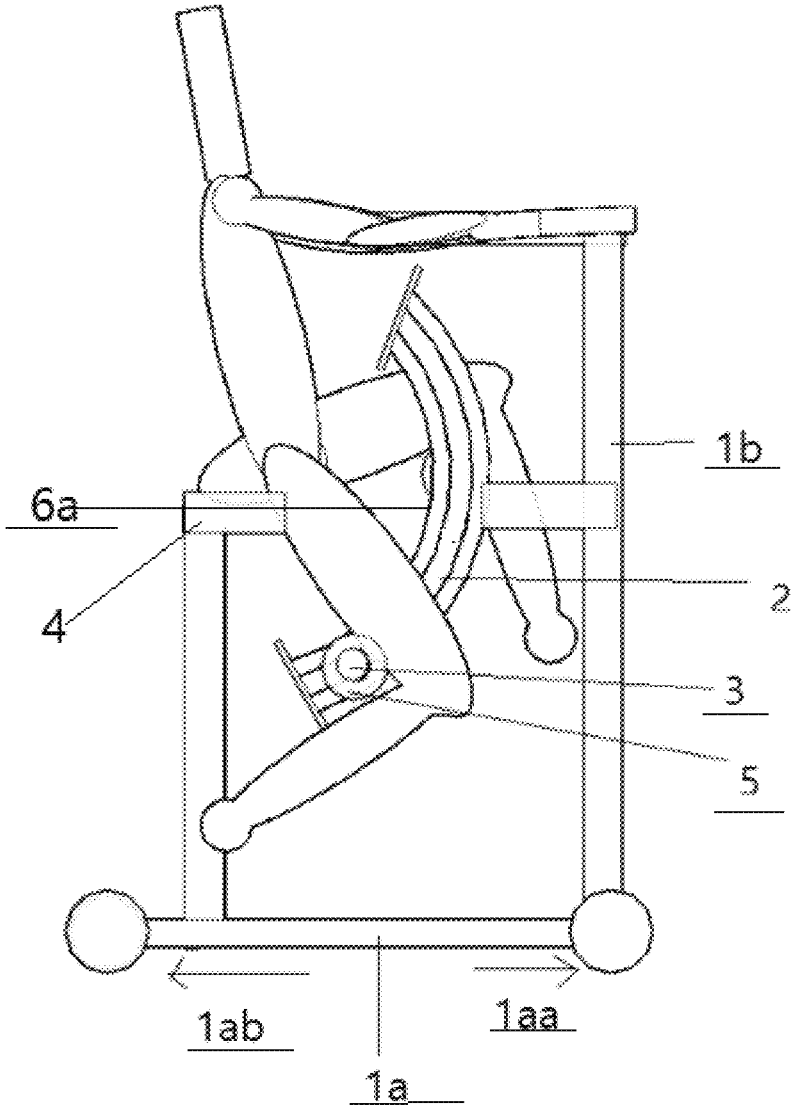
FIG. 4 is a side view of an embodiment of the present invention illustrating a guiding rail adjusted in a direction perpendicular to the ground.
Figure 6:
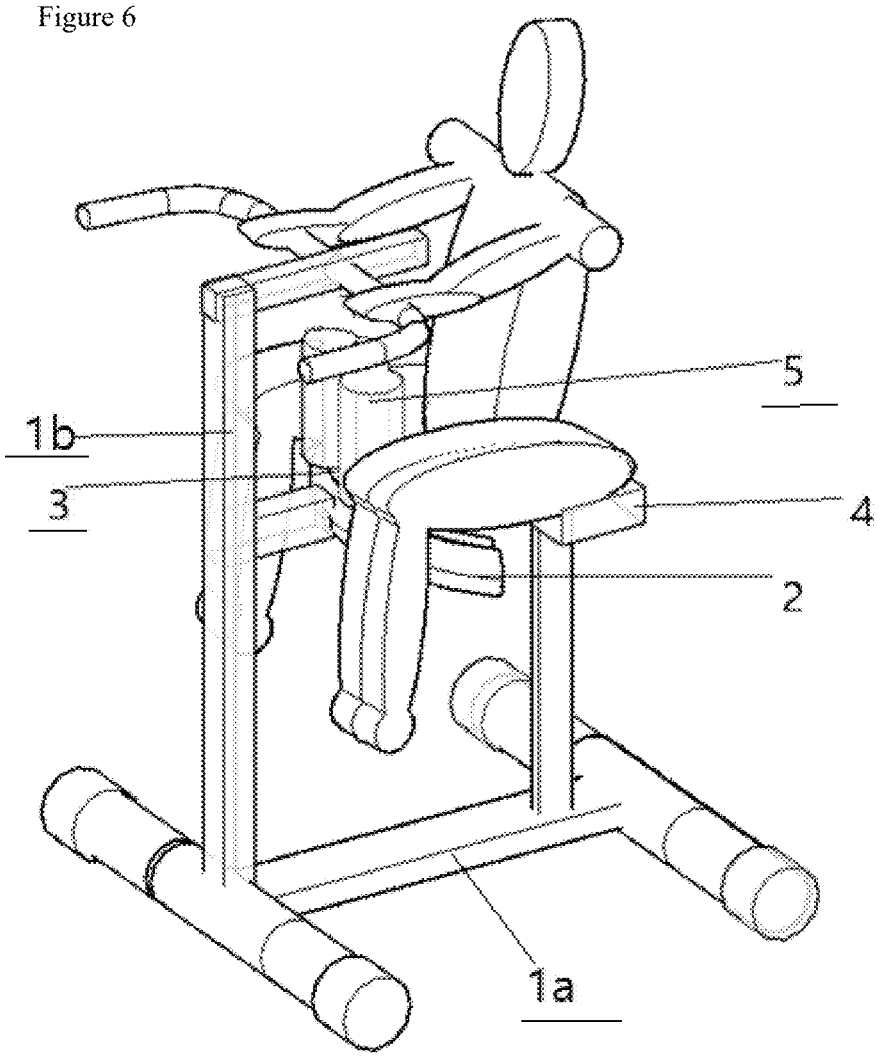
FIG. 6 is a perspective view of an embodiment of the present invention illustrating a guiding rail adjusted in a direction parallel to the ground.

The guiding rail 2 may be disposed perpendicularly to the frame 1 as illustrated in FIGS. 3, 4, and 5 or pivotably provided horizontally to the frame 1 as illustrated in FIGS. 6, 7, and 8, and the axis conversion part may include a fixing unit 6 for fixing the guiding rail 2 to the frame 1. Thus, the user may selectively perform a rotation movement of selectively lowering the legs and moving the legs backward from the start position in which the legs are pulled toward the user's chest, a movement of spreading both the legs apart and then putting the legs together as illustrated in FIG. 6, or a movement of spreading the legs from the start position of putting the legs together as illustrated in FIG. 7.

Preferably, the exercise device of the present invention may include a resistive force generator for generating a resistive force against pivoting of the slide arm 3. The resistive force generator may use a method of using a physical friction such as a tension of a belt and a magnetic drum and include a fluid resistor or a block box connected with a pneumatic pressure, a circular plate, and a wire.

In order to resolve a third problem of the technical object, As illustrated in FIGS. 9 to 12 (KR10-2021-0040066), The exercise device according to the present invention may include: a frame 1; a handle 7 connected to the frame 1; a seat 4 connected to the frame 1; a pivot axis 11 connected to the frame 1 and disposed in parallel to the hip joint of the user; an arm 10 connected to the pivot axis 11; and a shock absorber 12 connected to the arm 10. The exercise device may allow a user to perform an exercise similar to a natural movement of a body of the user by pivoting a portion of a body connected to the arm 10 and simultaneously performing a compression movement, and may be flexibly extended in length and automatically restored based on a different in body length caused by folding and unfolding of the hip joint and knees of the user by installing the shock absorber 12.

The shock absorber 12 may apply a resistive force to the inside thereof by pressing, hydraulic pressure, and spring elasticity according to the typical technology. The shock absorber 12 may be contracted and then extended or extended and then contracted on the contrary. Preferably, the shock absorber 12 may be integrated with the arm 10 or arranged linearly with the arm when viewed on a sagittal plane.

In addition, a muscle resistance according to the pivot exercise may increase by connecting a resistance body to the pivot axis 11. When an embodiment of the present invention is used as an indoor bicycle, a motion range of the bicycle may be extended, and an exercise effect may increase.

Also, an exercise device of the related art in which a pivot axis of an arm is disposed parallel to the hip joint or the knees causes inconvenience because the arm of the exercise device, which contacts a body according to a pivot angle of the hip joint or the knees, has a constant length. For example, since a distance from the pivot axis to the pedal decreases when legs are raised, and the distance increases when the legs are lowered, the fixed length of the arm causes inconvenience, and the knees are over-bent or over-extended to cause side effects. However, in the present invention, the distance may be flexibly extended and then automatically restored according to the difference of the body length when folded and unfolded by installing the shock absorber 12.

In order to resolve the third problem of the technical object, As illustrated in FIGS. 9 to 12 (KR 10-2021-0046163), The exercise device according to the present invention may include: a frame 1; a handle 7 connected to the frame; a seat 4 connected to the frame; a pivot axis 11 connected to the frame 1; an arm 10 pivotably connected to the pivot axis; a pipe 12*a* having a straight line shape and disposed linearly to the arm; and a bar 12*b* having a straight line shape and disposed inside the pipe to vertically move. Here, as the pedal 5 is connected to the bar 12*b*, the user may perform a movement of raising the legs toward the chest and then pivoting the legs around the hip joint and simultaneously pulling and compressing the legs in a state in which the user put the legs on the pedal 5. Through this, as the rotation exercise and the compression exercise are simultaneously performed, the exercise similar to the natural movement of the body may be performed, and when the user sits on the seat 4 to raise the legs toward the chest and then lower the legs and pivot the legs backward through the linear movement of the bar in the pipe, the length of the arm may be flexibly extended and then automatically restored according to the substantial variation in length of the legs contacting the arm caused by the pivoting exercise of the hip joint.

According to a typical technology through a pipe 12*a* and the bar 12*b* disposed in the pipe, the resistive force may decrease by the inner pneumatic pressure or hydraulic pressure or the spring elasticity, and the pipe 12*a* and the bar 12*b* may be contracted and then extended or extended and then contracted on the contrary. Also, a muscle resistance according to the pivot exercise may increase by connecting a resistance body to the pivot axis.

When an embodiment of the present invention is used as an indoor bicycle, a motion range of the bicycle may be extended, and an exercise effect may increase.

Figure 12:
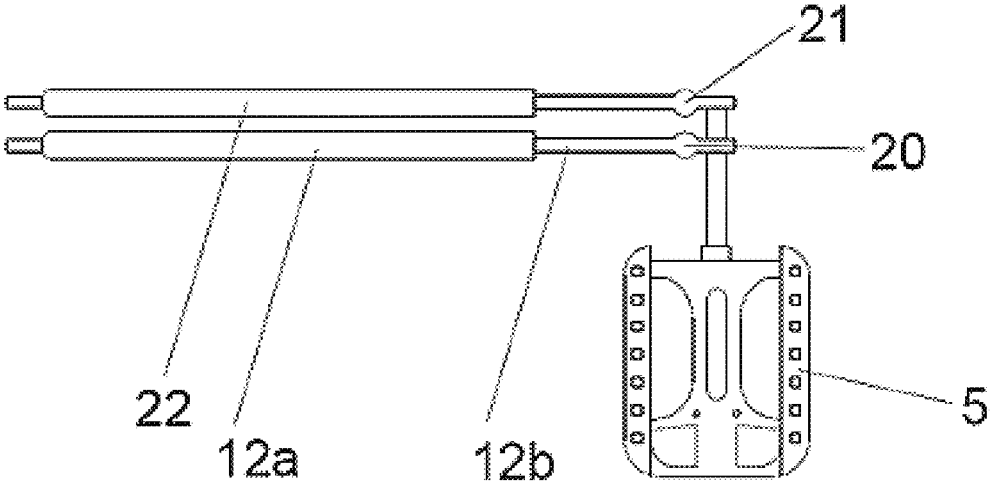
FIG. 12 is a partial view of an embodiment of the present invention illustrating an arm elongation means 12 having a straight line-shaped pipe 12*a* and a straight line-shaped bar 12*b* disposed inside the pipe to move vertically.
Figure 26:
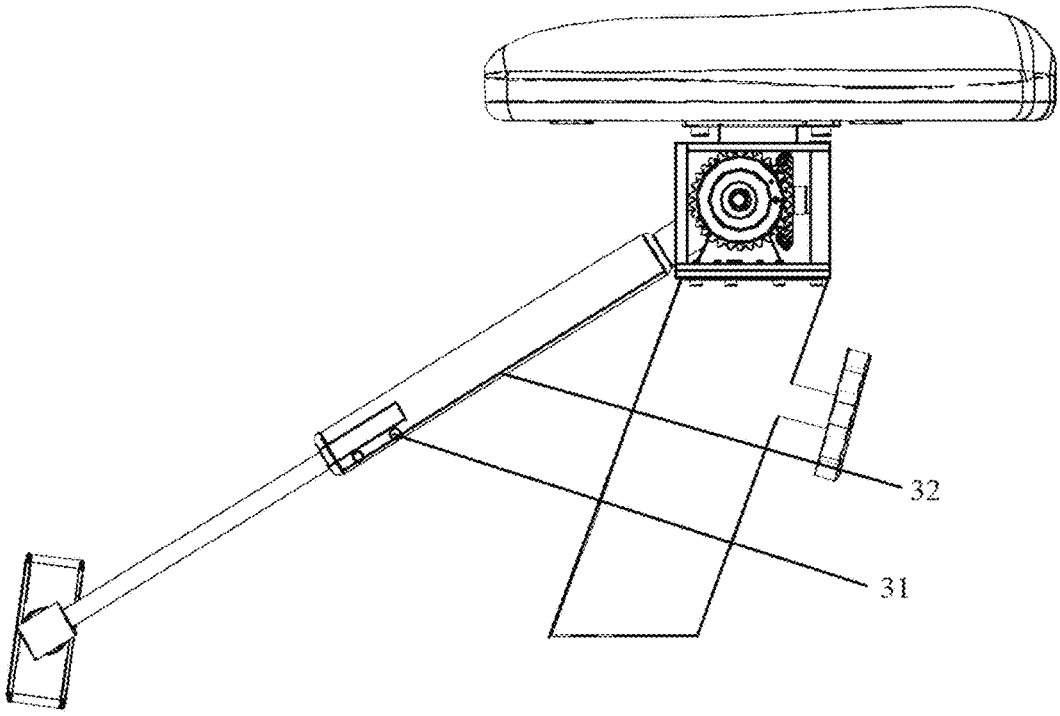
FIG. 26 is a front view illustrating a gear device of an embodiment of the present invention, including a single y-axis that is perpendicular to the ground.

In order to resolve a fourth problem of the technical object, As illustrated in FIG. 12 (KR 10-2021-0046163), the exercise device according to the present invention may include: a second pipe 22 connected in parallel to the pipe; a second bar 21 disposed in the second pipe; and a second bar fixing body 20 disposed on the bar, so that the pedal 5 does not rotate around the bar as the second bar 21 linearly moves to the outside from the inside of the second pipe 22 when the bar linearly moves to the outside form the inside of the pipe. Thus, when the user performs a compression exercise from a start position of putting the legs on the pedal 5 and pulling the legs, the pedal 5 may linearly moves instead of rotating. In addition, as illustrated in FIG. 26 (KR 10-2021-0046813), the pedal may not rotate around the pipe by selectively providing a guide rail to the pipe 31*a* and a roller 32*a* to the bar and selectively forming a groove in the bar or cutting one surface of the bar and providing a projection on the pipe.

Figure 19:
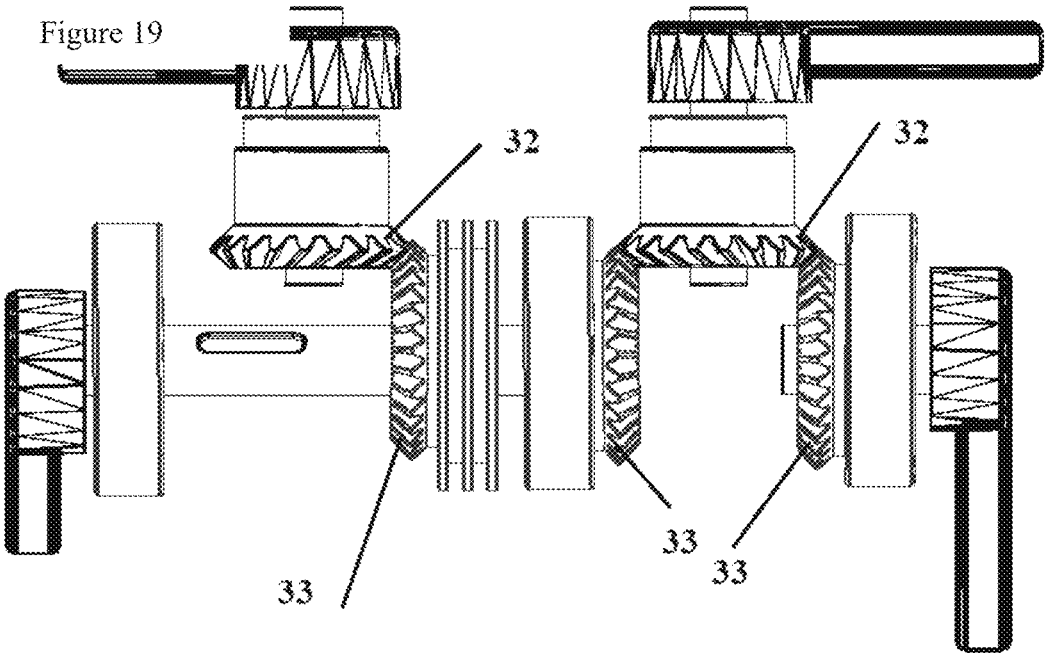
FIG. 19 is a front view of an embodiment of the present invention illustrating a gear device of FIG. 17 attached in a bicycle.
Figure 20:
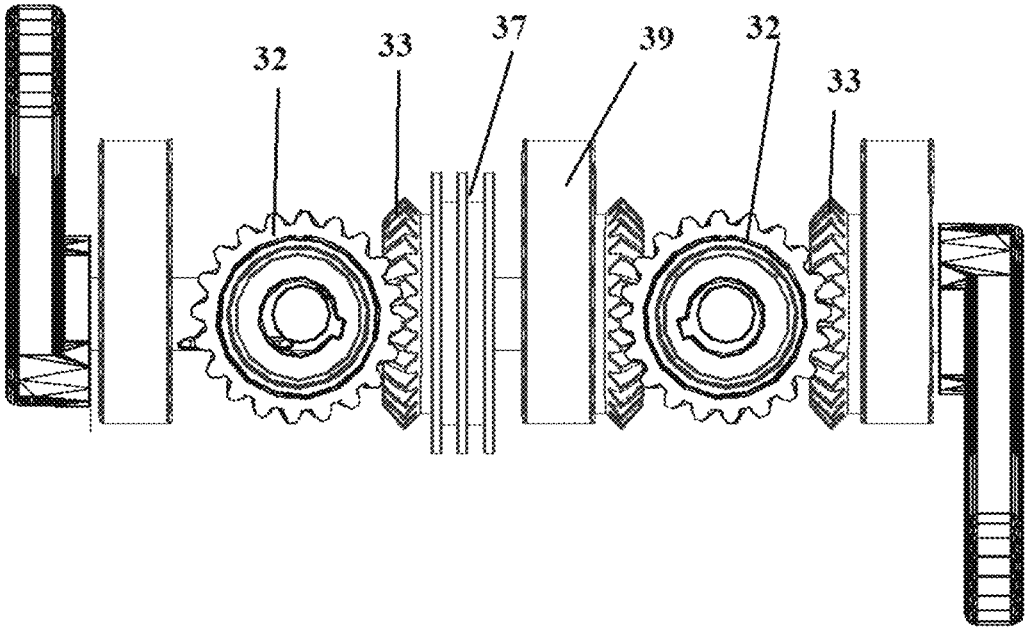
FIG. 20 is a partial view of an embodiment of the present invention, illustrating a gear device using wire and a roller.
Figure 21:
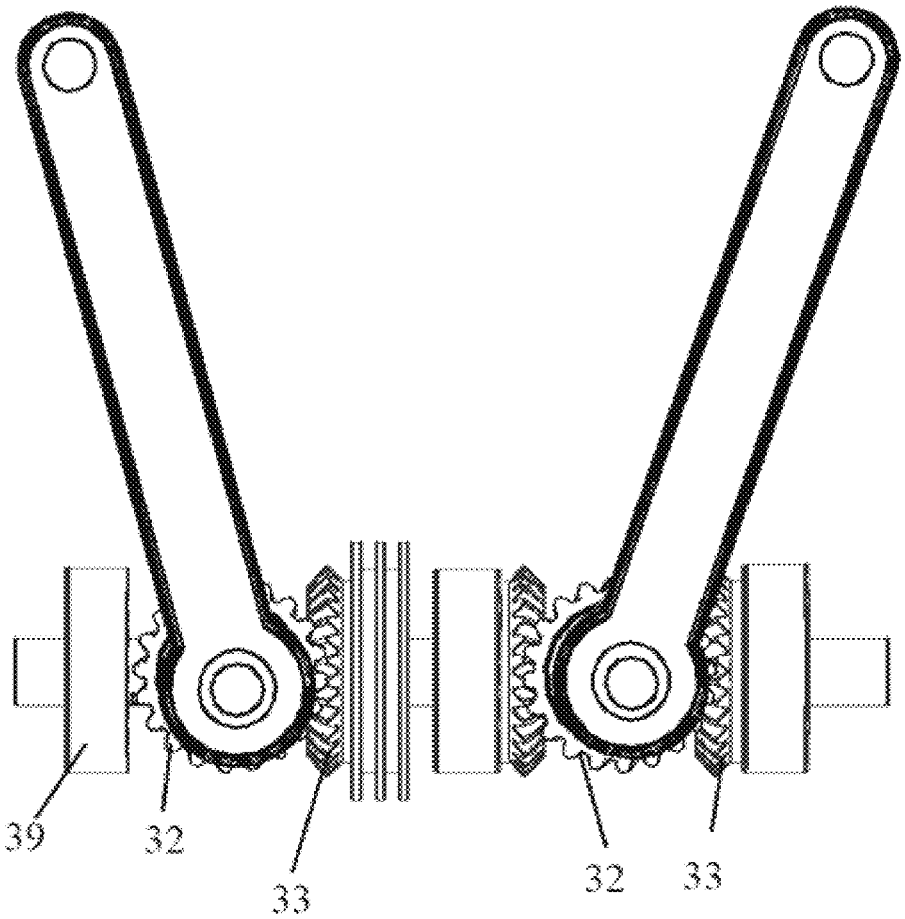
FIG. 21 is a partial view of an embodiment of the present invention, illustrating a gear device using wire and a roller.
Figure 22:
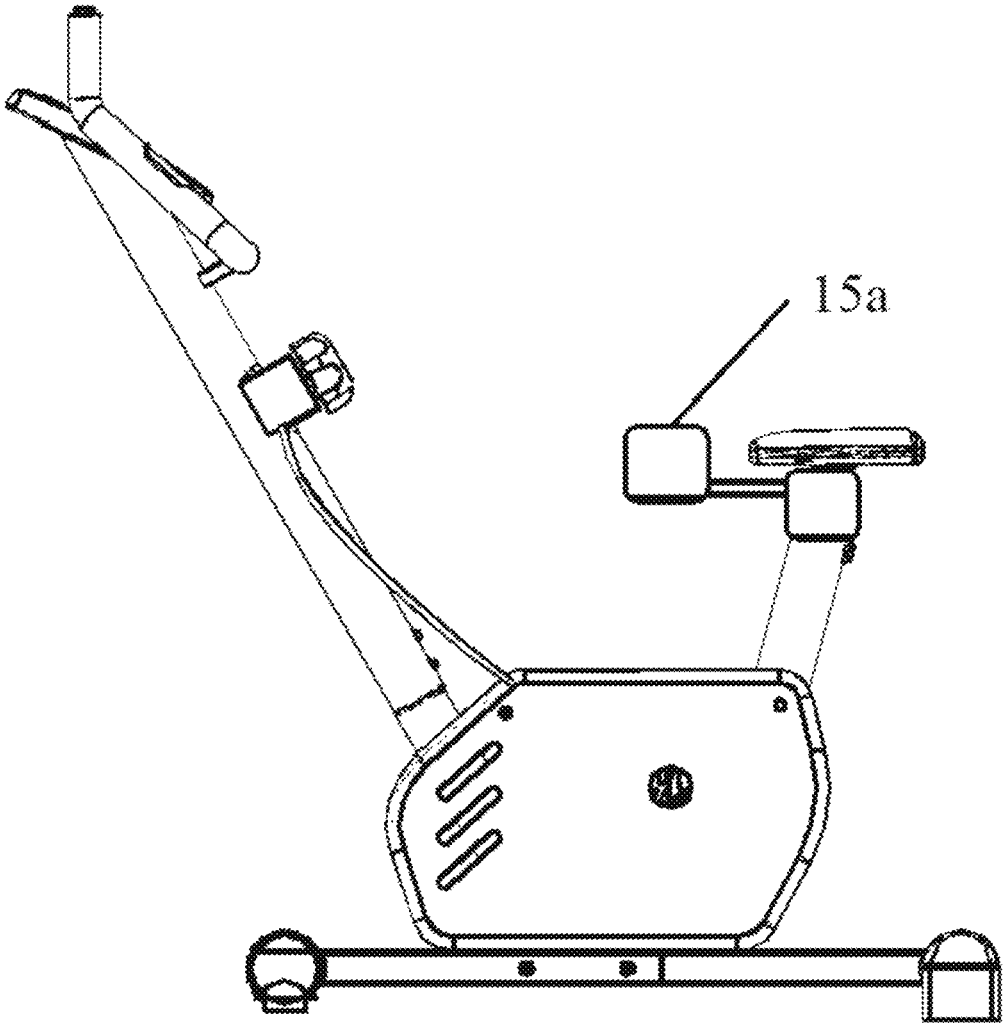
FIG. 22 is a partial view of an embodiment of the present invention illustrating an axis conversion gear device including an arm attached to an x-axis parallel to the ground and simultaneously attached to a y-axis perpendicular to the ground.
Figure 23:
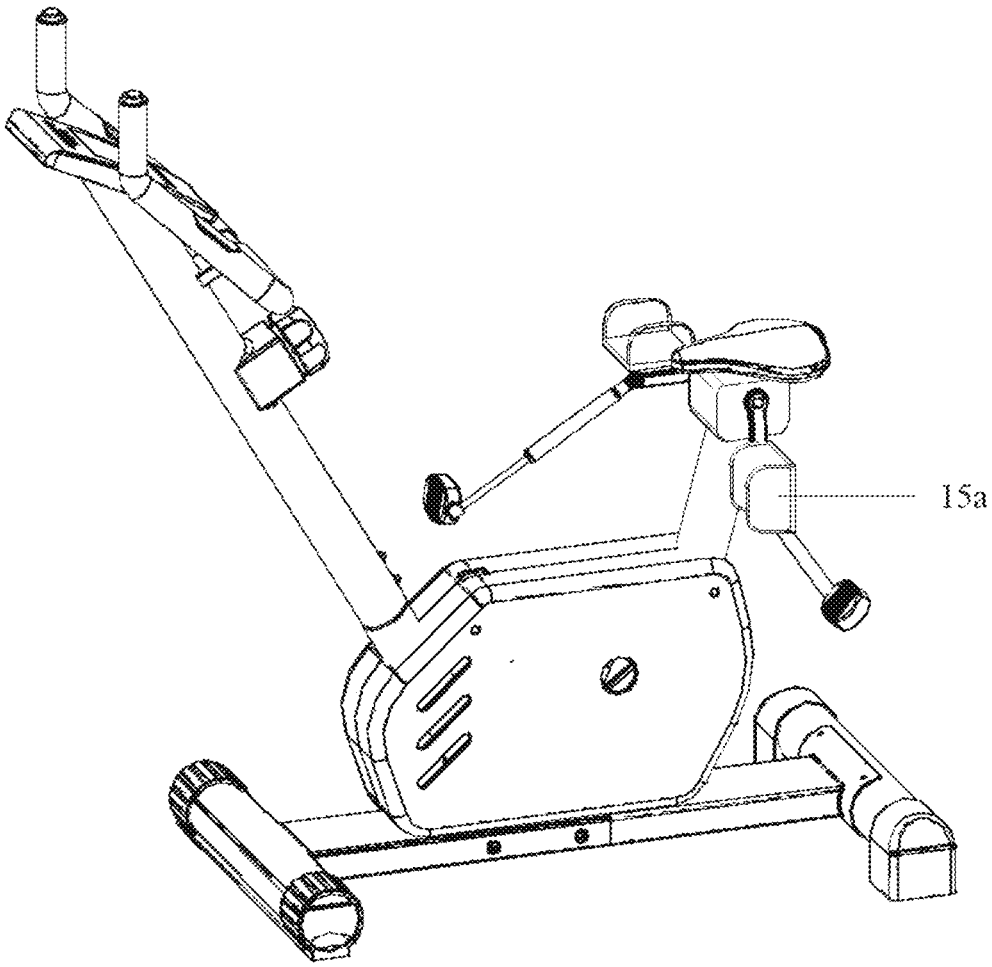
FIG. 23 is a partial view of an embodiment of the present invention illustrating an axis conversion gear device including an arm attached to an x-axis parallel to the ground.

In order to resolve a fifth problem of the technical object, As illustrated in FIGS. 13 to 25, the exercise device according to the present invention may include a gear device allowing left and right arms of the exercise device to organically rotate by using the gear and the roller and be automatically restored from an exercise ending position to the start pose, and to move on the axis parallel to the ground or rotate around the axis perpendicular to the ground, and as the gear device is attached to an existing bicycle to use a resistive body of the existing bicycle, the technology of the exercise device according to the related art may be realized, and the existing bicycle may be recycled. FIGS. 19 and 20 are views illustrating an axis conversion gear box according to an embodiment of the present invention, and FIGS. 22 and 23 are views illustrating a state in which the axis conversion gear box is attached to an indoor bicycle according to an embodiment of the present invention.

Figure 10:
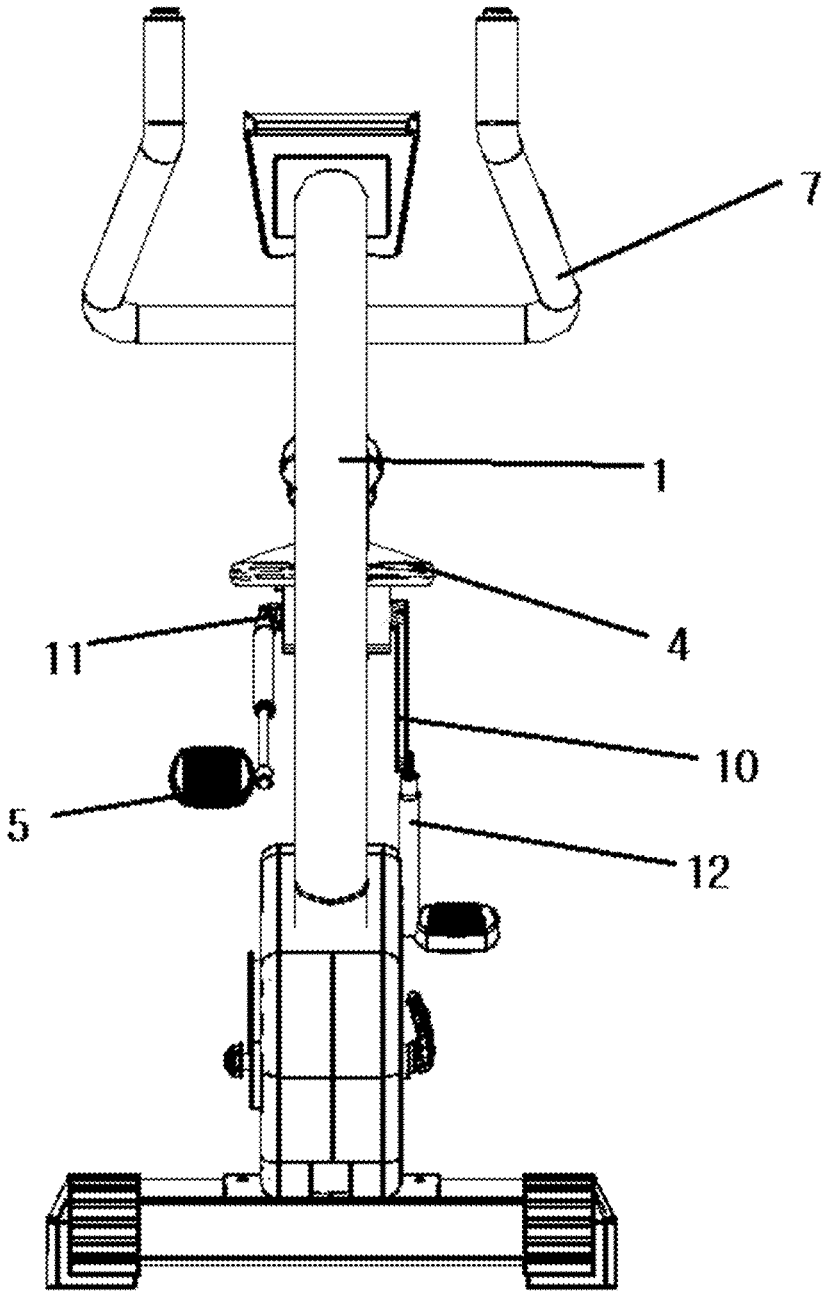
FIG. 10 is a front view of an embodiment of the present invention illustrating an arm 10 having an end connected to a pivot axis 11 and a second end coupled to an arm elongation means 12.
Figure 11:
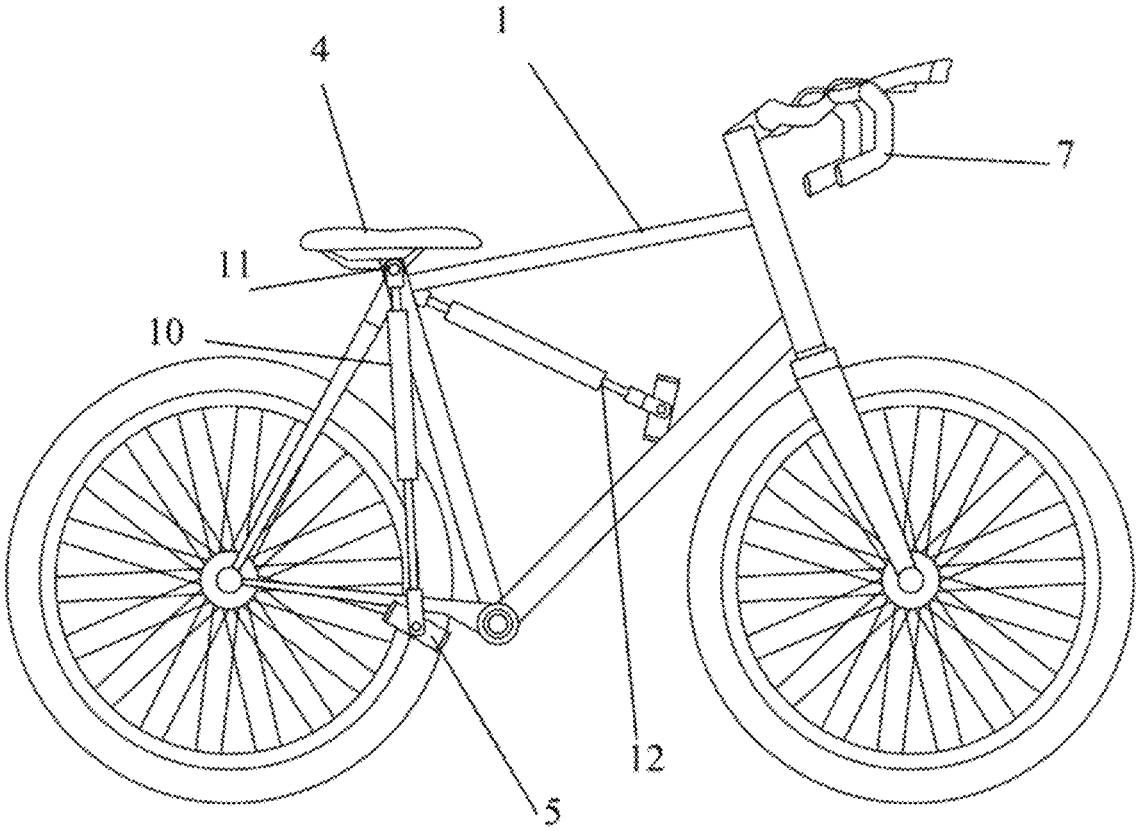
FIG. 11 is a side view of an embodiment of the present invention illustrating an arm 10 having an end connected to a pivot axis 11 and a second end coupled to an end of an arm elongation means 12 arranged linearly with the arm 10.
Figure 15:
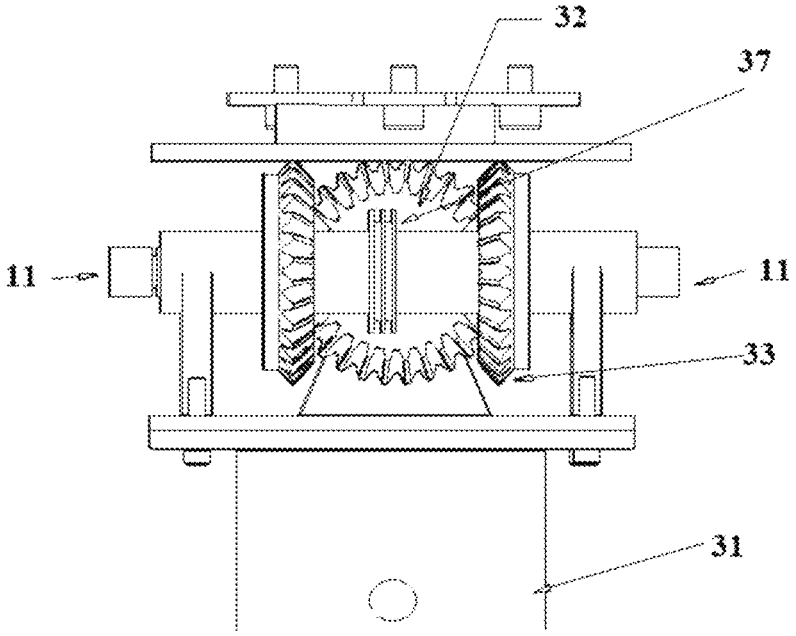
FIG. 15 is a front view of an embodiment of the present invention illustrating a gearbox of FIGS. 13, 14 attached in a bicycle.
Figure 16:
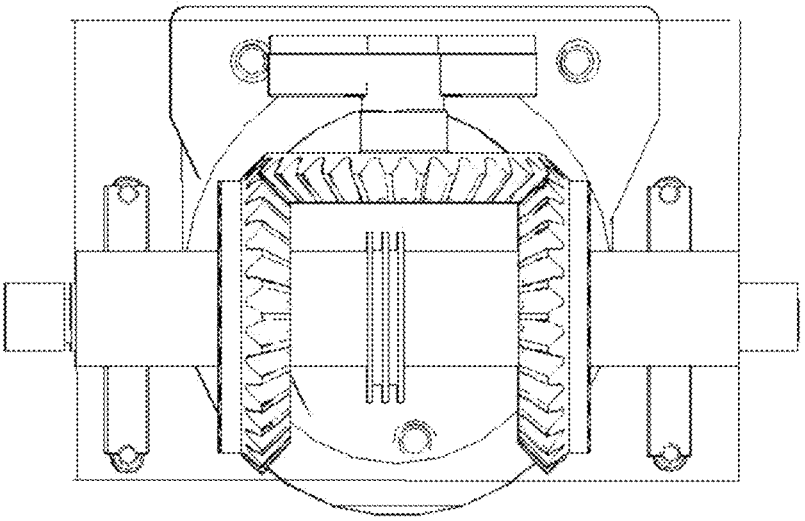
FIG. 16 is a side view of an embodiment of the present invention illustrating a gearbox of FIGS. 13, 14 secured in a bicycle.

FIGS. 15 and 16 are views illustrating a gear box, in which the axis conversion device is not provided according to another embodiment of the present invention. FIG. 10 is a front view illustrating a state in which the gear box according to another embodiment of the present invention is attached to the indoor bicycle.

Figure 13:
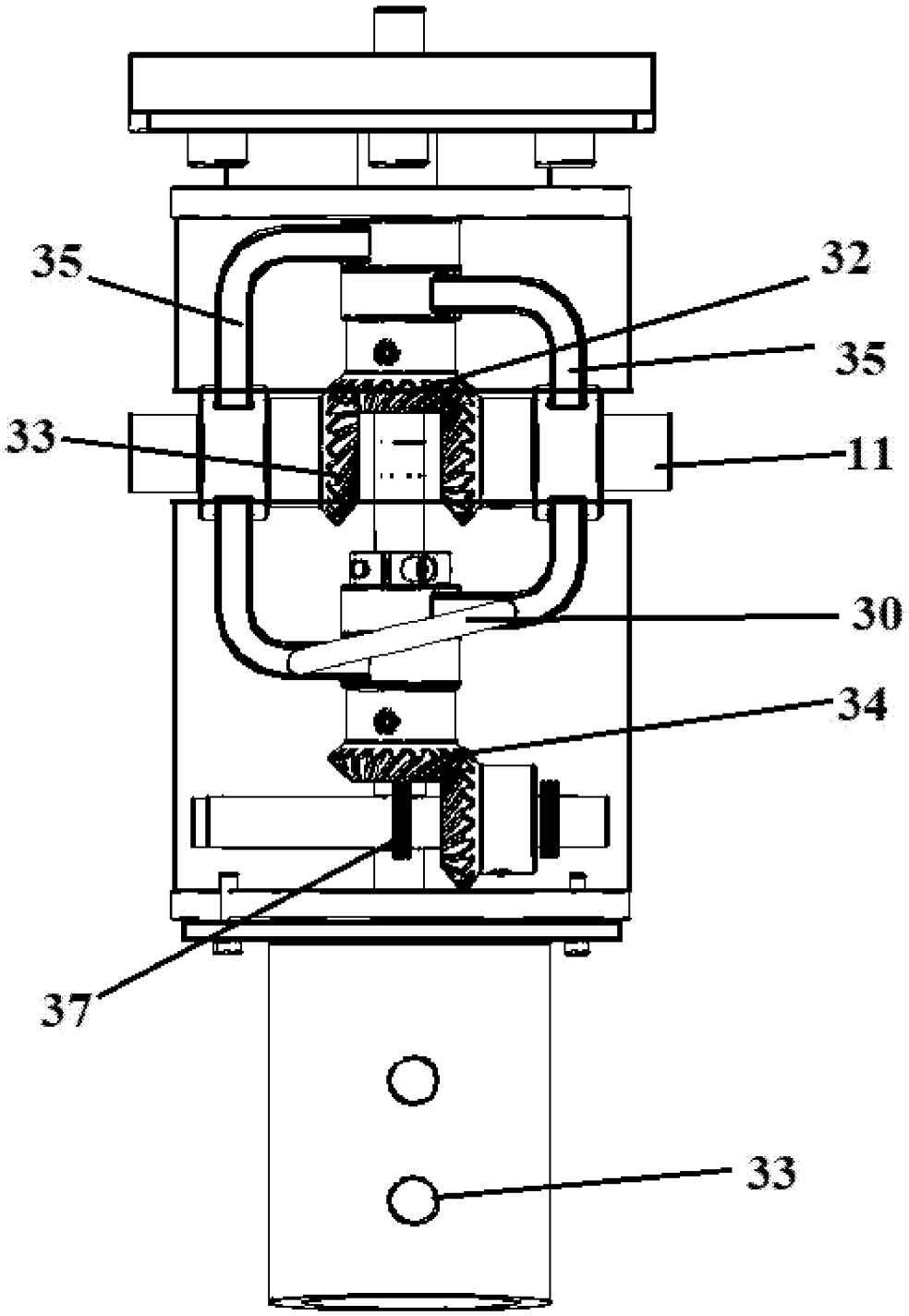
FIG. 13 is a partial view of an embodiment of the present invention illustrating an axis conversion gearbox.
Figure 14:
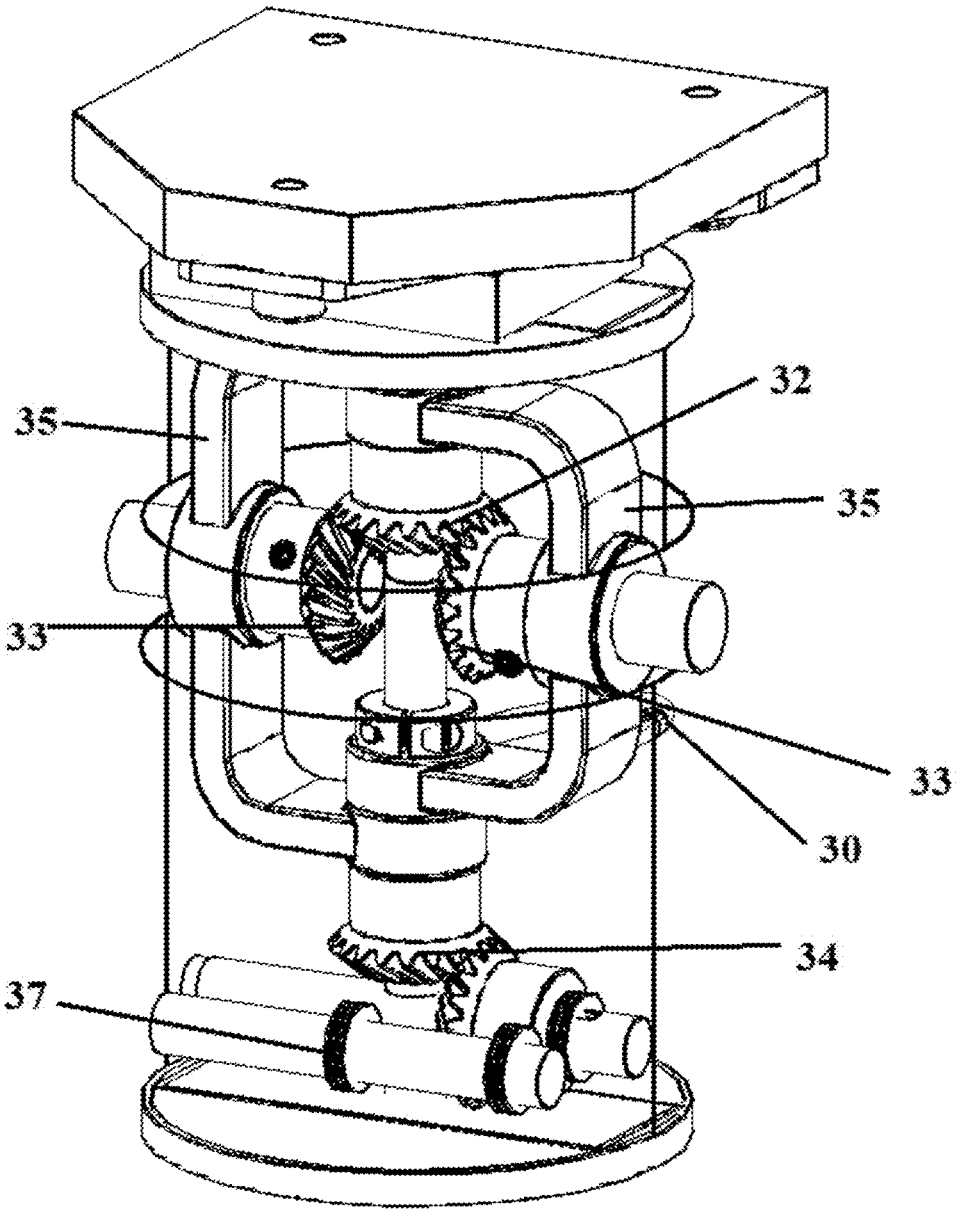
FIG. 14 is a partial view of an embodiment of the present invention illustrating an axis conversion gearbox.
Figure 17:
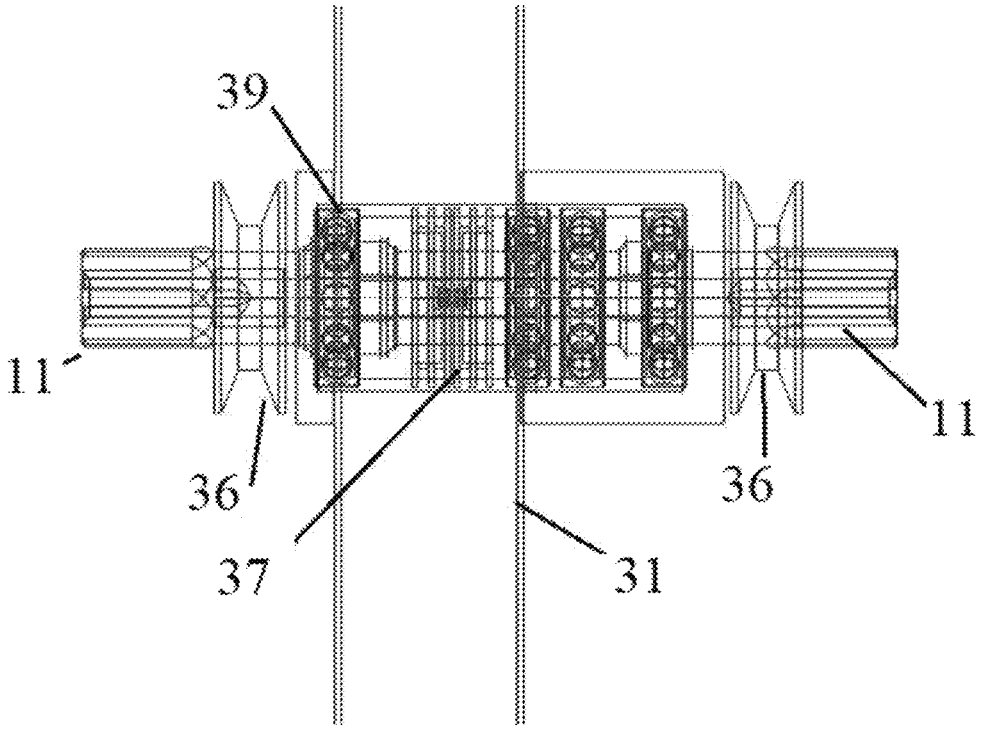
FIG. 17 is a partial view of an embodiment of the present invention illustrating a gear device in which an axis conversion device is not provided.
Figure 18:
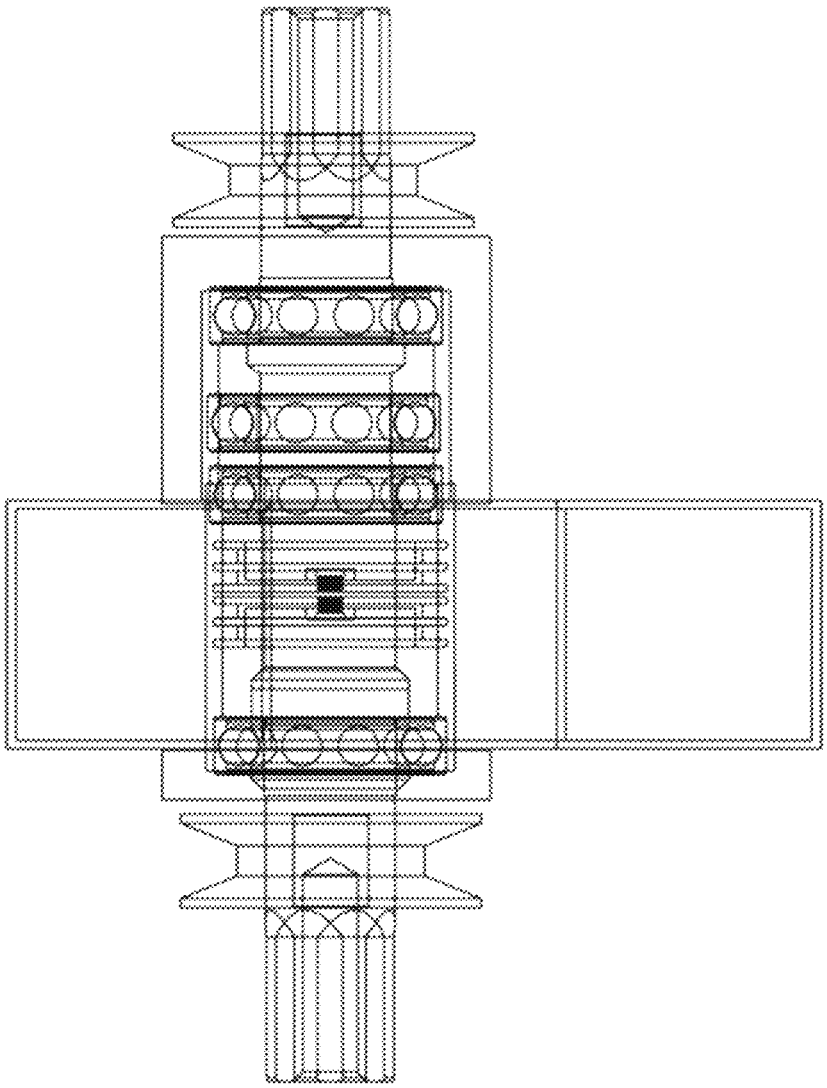
FIG. 18 is a partial view of an embodiment of the present invention illustrating a gear device in which an axis conversion device is not provided.

FIGS. 17 and 18 are views illustrating the gear box using a wire and a roller according to another embodiment of the present invention. As illustrated in FIGS. 13, 14 and 17, The gear device includes a pivot axis 11, a horizontal spiral gear or bevel gear 32, a vertical gear or bevel gear 33, a second spiral or bevel gear 34, an arm 35 connected to the bevel gear 32 or 33, a roller 36, a tension belt roller 37, a spur gear or a helical gear, a bearing 39, a device 30 for fixing rotation around a y-axis perpendicular to the ground, and a device 31 for fixing the gear device to a vertical frame of another exercise device. Hereinafter, a description on the well-known technology will be omitted.

Figure 24:
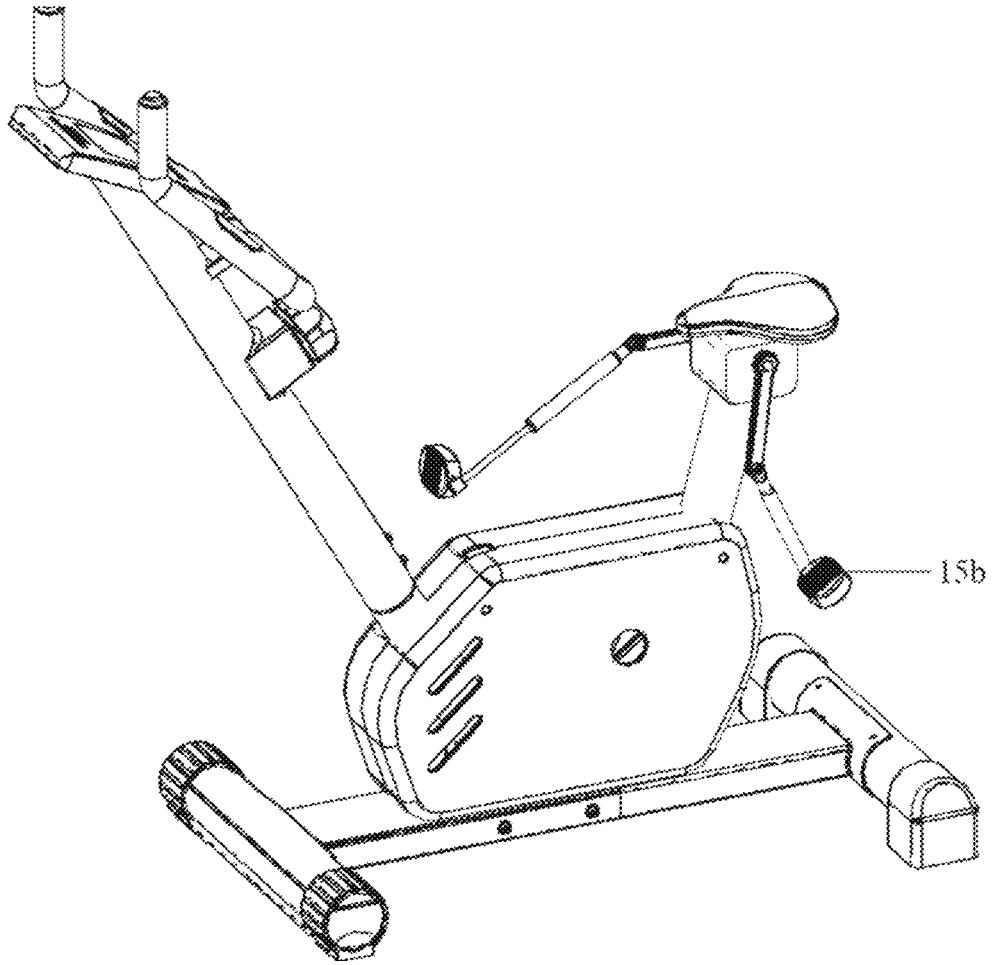
FIG. 24 is a partial view of an embodiment of the present invention illustrating an axis conversion gear device including an arm attached to a y-axis perpendicular to the ground.
Figure 25:
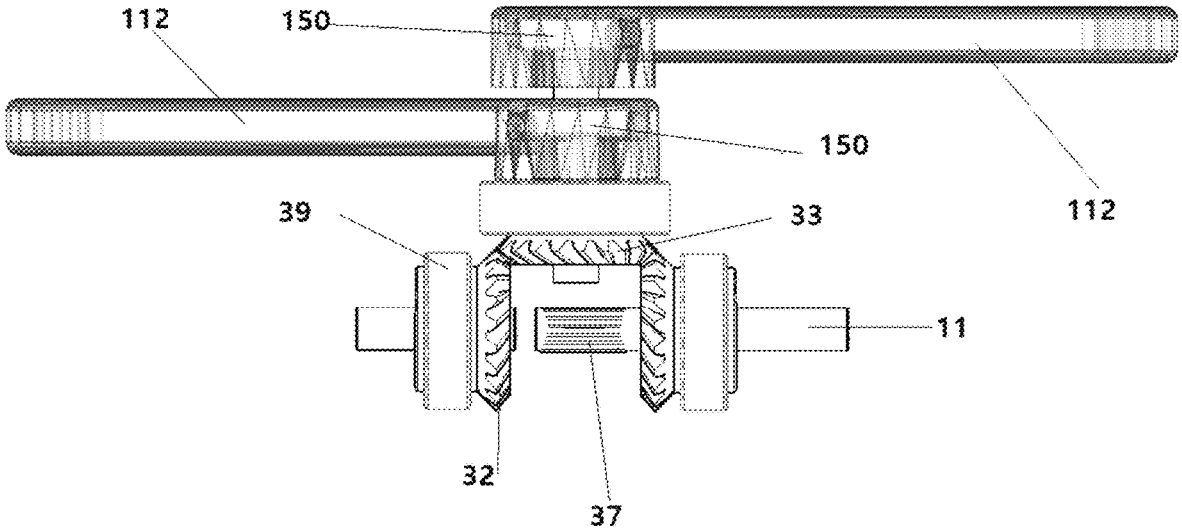
FIG. 25 is a side view illustrating a gear device of an embodiment of the present invention attached to a bicycle.

As illustrated in FIGS. 13 to 14 (KR 10-2020-0163490), the axis conversion gear device according to the present invention may include the arm attached onto a x-axis parallel to the ground and simultaneously attached onto the y-axis perpendicular to the ground and as illustrated in FIG. 25, the axis conversion gear device may include a single y-axis. In addition, as illustrated on FIGS. 13 and 14, the axis conversion gear device may include a through which a right x-axis pivot axis passes; a right arm having an upper end portion and a lower end portion through which a y-axis pivot axis passes; and a left penetrating portion through which a left x-axis pivot axis passes, a left arm having an upper end portion and a lower end portion through which the y-axis pivot axis passes, wherein the right x-axis pivot axis passes through the right penetrating portion to be rotatable, and the left x-axis pivot axis passes through the left penetrating portion to be rotatable, wherein, in a case of connecting the gear device to a lower body exercise apparatus, when a user fixes the arm to a position parallel to a ground, the user is able to perform a movement of lowering downward or kicking backward about a hip joint as an axis in a starting position of pulling toward a chest, and, when the user fixes the arm to a position perpendicular to the ground, the user is able to close and open a body while placing the body of the user against an end of the arm. Since the axis conversion gear device according to the present invention may include the arm attached onto the x-axis parallel to the ground as illustrated in FIG. 20 and attached onto the y-axis perpendicular to the ground as illustrated in FIG. 21 the user may selectively perform a movement of lowering the legs and moving the legs backward or a movement of putting the legs together. A leg pad may be disposed below the thigh of the user as illustrated in FIG. 23 (15*a*) or disposed below of the legs of the user as illustrated in FIG. 24 (15*b*). The leg pad may have a "⊏"-shape as illustrated in FIG. 23 or a "∟"-shape.

In addition, (KR 10-2020-0170941), the exercise device according to the present invention is configured such that as a planetary gear is provided to a y-axis pivot device connected to the arm.

As another example of the gear device (KR 10-2021-0002955), as a plurality of shafts and a plurality of arms are provided to the y-axis pivot device, and spur gears are provided to the y-axis pivot device or the arm and engaged with each other, when the one side arm connected to the y-axis pivot device rotates clockwise, the other side arm rotates counterclockwise.

In order to resolve an eighth problem of the technical object, the exercise device according to the present invention may be configured such that a handle angle adjusting device is provided to an exercise device similar to a total hip machine to perform a complex thigh and hip strengthening exercise by using one exercise device. To this end, the exercise device according to the present invention includes: an arm 10 in which a pivot axis is pivotably disposed at a position parallel to the hip joint of the user; a bar connected to the arm 10 and pivotably disposed below the legs of the user; a handle 7 disposed parallel to left and right sides of the user; the handle angle adjusting device; a weight adjusting device; and an arm start section adjusting device. The handle angle adjusting device adjusts the handle to be disposed at the same position, and 62 as the general total hip machine when the user performs the movement of moving the legs backward and putting the legs together or apart, and adjusts the handle to be disposed at a position at which the handle is not collided with the body of the user when the user performs squat or lunge.

In order to resolve an eleventh problem of the technical object, as illustrated in FIGS. 27 to 36 (KR 10-2021-0035113), the exercise device of the present invention may include a frame I 61 including a ground support I 62 disposed in parallel to the ground, a horizontal body I 63 disposed in parallel to the first ground support, and a vertical support I 64 for connecting the ground support I and the horizontal body I. The exercise device may further include a frame Ⅱ 65 connected to the frame I. The frame Ⅱ 65 includes a ground support Ⅱ 66 connected to the ground support I 62 of the frame I, a horizontal body Ⅱ 4 disposed in parallel to the ground support Ⅱ 66, and a vertical support Ⅱ 68 for connecting the ground support Ⅱ and the horizontal body Ⅱ. Preferably, each of the horizontal body I and the horizontal body Ⅱ may have a plate shape. The exercise device according to the present invention may be configured such that an arm 10 is provided, a pivot axis 11 for pivotably connecting the arm to the frame is provided in plurality, and the arm is attached to and detached from the plurality of pivot axes. Preferably, when the pivot axis is engaged with the arm as a hole having a rectangular shape (▭) is formed in one end of the arm, one end of the pivot axis has a rectangular shape (▭), and a resistive body such as an elastic body or a wire is connected to the other end of the pivot axis, the arm may rotate, the pivot axis connected to the arm may rotate, and the resistive body may also rotate. As the plurality of pivot axes are provided to each of the first frame and the second frame, the user may selectively perform inner thigh, leg curl, leg extension, hip thrust, back-extension, and arm curl exercises. Preferably, the first frame may be used as the handle, and the second frame may be used as the seat according to the kind of exercises. In addition, the arm may preferably have a "¬"-shape or a "T"-shape. Also, the first ground support and the second ground support may be provided in parallel to or perpendicularly to the first horizontal body. Furthermore, preferably, the second vertical support may adjust an angle of the second horizontal body, and the user may adjust the angle of the second horizontal body suitable for the kind of exercises.

The exercise device according to the present invention is characterized in that the first frame and the second frame are connected to each other, and the pivot axis is provided in plurality as illustrated in FIGS. 27 to 36. Also, the exercise device according to the present invention is characterized in that an arm attaching and detaching device 67 is provided at one end of the arm and preferably has a "▭"-shape to adjust a start section of the arm according to the kind of exercises that user wants. Specifically, as illustrated in FIG. 35, an arm connecting body has a hole having a "▭"-shape, and a pivot axis also has a "▭"-shape. For example, when the user wants to perform the leg curl exercise, an arm connecting body may be adjusted to be attached to an upper portion of the pivot axis as illustrated in FIG. 27, and when the user wants to perform the leg extension exercise on the contrary, the arm attaching and detaching device may be adjusted to be attached to a lower portion of the pivot axis as illustrated in FIG. 34, so that the user may adjust the start section suitable for the kind of exercises that user wants. The arm attaching and detaching device may have a triangular shape or a sprocket shape in addition to the "▭"-shape. The exercise device according to the present invention is characterized by including an arm connecting body 69 for easily attaching or detaching the arm to or from the pivot axis. The arm connecting body may be provided in the form of bolt and nut fastening device and have a size enough to provide grip feeling so that the user easily attach and detach the arm connecting body.

INDUSTRIAL APPLICABILITY

The exercise device according to the present invention may be used for muscle strengthening equipment, an indoor exercise device, a bicycle, an indoor bicycle, a complex exercise device, a band exercise device, and an exercise device gear.

I claim:

1. A lower body exercise apparatus comprising:

a seat connected to a frame for a user to seat on; and a gear device configured at a position adjacent to the seat under the seat, wherein the gear device comprises:

a left rotating member and a right rotating member coaxially disposed along a first rotational axis line that is parallel to a ground, the left rotating member and the right rotating member each being rotatably supported relative to the frame by bearings about the first rotational axis line; and an intermediate rotating member rotatably supported relative to the frame by bearings about a second rotational axis line that intersects the first rotational axis line and is vertical to the ground;

a left bevel gear coupled to the left rotating member;

a right bevel gear coupled to the right rotating member; and an intermediate bevel gear coupled to the intermediate rotating member;

wherein the left bevel gear and the right bevel gear are mechanically connected to rotate in opposite directions via the intermediate bevel gear, at least one exercise arm removably coupled to a selected one of the left rotating member, the right rotating member, or the intermediate rotating member; and a pedal coupled to a distal end portion of the at least one exercise arm;

wherein the apparatus is configured to switch between:

(i) a first configuration in which the at least one exercise arm is removably coupled to the left rotating member to pivot about the first rotational axis line and swing reciprocally along an arcuate path between an elevated starting position and a lowered position, wherein rotation of the left rotating member in a first direction causes the right rotating member to rotate in an opposite direction via the gear device, thereby urging the at least one exercise arm toward the elevated starting position thereby facilitating a reciprocating movement of a user's leg about a hip joint; and (ii) a second configuration in which the at least one exercise arm is separated from the left rotating member or the right rotating member and is coupled to the intermediate rotating member so as to swing reciprocally about the intermediate rotating member along an arcuate path between a laterally outward position and a laterally inward position, thereby facilitating abduction and adduction movements of a user's legs about a hip joint.

* * * * *